US009302196B2

(12) United States Patent
Norman

(10) Patent No.: US 9,302,196 B2
(45) Date of Patent: Apr. 5, 2016

(54) CONSTRUCTION SET

(75) Inventor: Philip Ross Norman, Maidenhead (GB)

(73) Assignee: ROBOSYNTHESIS LIMITED, Buck (GB)

( * ) Notice: Subject to any disclaimer, the term of this patent is extended or adjusted under 35 U.S.C. 154(b) by 632 days.

(21) Appl. No.: 13/636,492

(22) PCT Filed: Mar. 23, 2011

(86) PCT No.: PCT/GB2011/000417

§ 371 (c)(1),
(2), (4) Date: Jan. 10, 2013

(87) PCT Pub. No.: WO2011/117581

PCT Pub. Date: Sep. 29, 2011

(65) Prior Publication Data

US 2013/0102221 A1 Apr. 25, 2013

(30) Foreign Application Priority Data

Mar. 23, 2010 (FR) ..... 10 52092

(51) Int. Cl.
*A63H 33/04* (2006.01)
*A63H 33/08* (2006.01)
*A63H 33/10* (2006.01)

(52) U.S. Cl.
CPC ..... *A63H 33/088* (2013.01); *A63H 33/04* (2013.01); *A63H 33/084* (2013.01); *A63H 33/108* (2013.01)

(58) Field of Classification Search
CPC ..... A63H 33/04; A63H 33/06; A63H 33/062; A63H 33/08; A63H 33/084; A63H 33/086; A63H 33/088; A63H 3/10; A63H 33/108
See application file for complete search history.

(56) References Cited

U.S. PATENT DOCUMENTS 4,389,809 A * 6/1983 Fischer ..... A63H 33/102 403/297
4,647,241 A * 3/1987 Weber ..... F16B 7/0426 403/18

(Continued)

FOREIGN PATENT DOCUMENTS

EP 1 022 040 A2 7/2000
WO 2008/093028 A1 8/2008

OTHER PUBLICATIONS

International Search Report for PCT/GB2011/000417 dated Jul. 5, 2011.

*Primary Examiner* — Gene Kim
*Assistant Examiner* — Alyssa Hylinski
(74) *Attorney, Agent, or Firm* — Sughrue Mion, PLLC

(57) ABSTRACT

A construction set comprises a plurality of elements mutually co-operable to produce at least one assembly, wherein the elements comprise a plurality of connectors (100, 100') each comprising a substantially cylindrical body and a hollow base, the body being provided with a radially extending cylindrical projection (130') and the base with at least one groove (131') and the projection and the groove being shaped to permit assembly of two such connectors (100, 100') in mutually orthogonal relationship by engagement of the projection of one of those connectors in the at least one groove of the other one of those connectors. The elements of the set further comprise a plurality of locking members (300) of part-annular form curved substantially in conformity with the cylindrical surface of the body of each connector (100, 100'), the body of each connector being provided with at least one opening (111) communicating with the interior of the base and each locking member (300) being provided at its concave side with a projecting locking nose (320) insertable through the at least one opening (111) of each connector (100) to protrude into the interior of the base for axial retention of another element (100') of the set assembled in axial or orthogonal relationship with the respective connector.

11 Claims, 16 Drawing Sheets

(56) References Cited

U.S. PATENT DOCUMENTS 5,094,643 A * 3/1992 Bolli ..... A63H 33/04 403/348
5,361,919 A * 11/1994 Hull ..... B65D 81/361 215/228
5,402,903 A * 4/1995 Mann ..... B65D 81/361 220/23.6
5,503,497 A * 4/1996 Dudley ..... A63H 33/042 403/103
5,704,186 A * 1/1998 Alcalay ..... A63H 33/062 403/188
6,296,541 B1 * 10/2001 Bezalel ..... A63H 33/08 206/504
6,702,642 B1 * 3/2004 Parein ..... A63H 33/08 446/105
6,899,588 B1 5/2005 Clever et al.
8,568,187 B2 * 10/2013 Norman ..... A63H 33/084 273/156
2008/0075528 A1 * 3/2008 Marzetta ..... A63H 33/042 403/238
2008/0232899 A1 * 9/2008 Berg ..... F16B 2/10 403/359.6

* cited by examiner

CONSTRUCTION SET

CROSS REFERENCE TO RELATED APPLICATIONS

This application is a National Stage of International Application No. PCT/GB2011/000417 filed Mar. 23, 2011, claiming priority based on French Patent Application No. 1052092 filed Mar. 23, 2010, the contents of all of which are incorporated herein by reference in their entirety.

The present invention relates to a construction set, particularly a set of modular composition enabling, for example, construction of structures such as robots.

A known construction set, which is described in WO 2008/093028, comprises a plurality of different elements which are mutually co-operable for the purpose of creating assemblies, of which one form of element—termed connector—has a substantially cylindrical body with a cylindrical surface shaped for co-operation with the base, which is suitably shaped for this purpose, of another connector to enable assembly. Specifically, the cylindrical surface of each connector has at least one radially extending cylindrical projection which is co-operable, for the purpose of assembly, with at least one groove of conforming shape formed in the base of another such connector. The possibilities of connection proposed in WO 2008/093028 exceed those available in classic robotic structures.

The set disclosed in WO 2008/093028 allows formation of assemblies in which the connectors have the same functional capabilities regardless of their orientation in an assembly.

The prior art also embraces motorised modular assembly devices formed by a plurality of static and/or motorised elements able to be set in motion by certain connections.

The known assemblies are created by the interfitting of components and the component connections are maintained by friction between various contacting surfaces. However, these connections may not always be sufficient when the assemblies are subjected to significant force. For example, certain robotic applications cannot be satisfied in particular circumstances when connection is by mere friction.

The object of the present invention is therefore to achieve an improved rigidity in the connection of elements of a construction set without compromising the range of assembly possibilities, in particular the modularity inherent in such a construction set.

Other objects and advantages of the invention will be apparent from the following description.

According to the invention a construction set is formed by a plurality of different elements which are mutually co-operable for the purpose of assembly, of which one form of element, termed connector, has a substantially cylindrical body with a cylindrical surface shaped in order to co-operate, for the purpose of assembly, with the base, which is suitably shaped, of another connector, the cylindrical surface of the body of each connector comprising at least one radially extending cylindrical projection co-operable, for the purpose of assembly, with at least one groove of a suitable shape formed in each base of the connector, wherein the body of each connector is formed with at least one opening traversing the body on an axis perpendicular to the cylinder axis of the body, the opening permitting introduction of a part-annular locking member matching the curvature of the cylinder formed by the body in the region of the opening and by a locking nose insertable through the opening and emerging in the interior of the body for the purpose of axial retention of elements of the set able to be associated axially or orthogonally with the connector.

This provides an orthogonal or axial coupling which is more rigid and guarantees maintenance of the connection. The rigidity can be optimised by provision of a plurality of the openings in the body of the connector and correspondingly utilisation of the same number of locking members as openings.

The combination of a part-annular locking member shape, which matches the exterior surface of the body, and a locking projection protruding towards the interior of the body ensures firm positioning of the locking member.

The protrusion created in the interior of the body by the locking nose of the locking member can be exploited for various purposes.

In a preferred embodiment, the body of each connector is formed with a plurality of openings allowing insertion of the locking noses of a corresponding plurality of locking members, the ends of the locking members being interengageable when all of the openings are occupied by locking noses of the locking members, the locking members then forming a ring around the body of the connector. This ring contributes to protection and robustness of the connection.

In a first utilisation associated with an axial assembly, the locking nose of each locking member can be employed to form an axial abutment with a collar of an axial adapter axially engageable in the connector.

In a further utilisation associated with an orthogonal assembly of two connectors, the cylindrical projection of each connector forms a circular flange coaxial with the connector body, which flange has on at least one of its faces at least one circular channel. This channel receives, for the purpose of maintaining position, the locking nose of a locking member when, in an orthogonal assembly of the two connectors, one of the connectors co-operates with at least one appropriately shaped groove in another connector.

In order to optimise assembly, the cylindrical projection of each connector forms a circular flange coaxial with the connector body and is formed with slots able to receive an orthogonal adapter. These slots can equally co-operate with the locking nose of a locking member for the purpose of preventing relative rotational movement of two elements assembled in orthogonal relationship.

This orthogonal coupling is preferably achieved with an orthogonal adapter comprising a peg capable of being axially associated with a connector and a cradle having a part-cylindrical surface with a notional cylinder axis orthogonal to the axis of the peg, the cradle being co-operable with the body of a connector as well as the cylindrical projection thereof.

An orthogonal assembly can also be realised by an orthogonal coupling member comprising a first cylindrical portion co-operable with the at least one channel formed in the projection of each connector and a second cylindrical portion projecting orthogonally with respect to the first portion and having a profile co-operable with the cavity of a hub in the base of each connector.

This orthogonal coupling member can eliminate the need for use of a locking member for positional retention. Thus, this orthogonal coupling member can function with simpler connectors without transverse openings in the bodies thereof. This orthogonal coupling member can be utilised in the case of assembly in two phases where a first phase is realised without locking for the purpose of testing the assembly and where a second phase is carried out with locking after the assembly has been proved and enhanced rigidity judged necessary. Thus, both locked assemblies and non-locked assemblies can be achieved with substantially the same connectors.

In order to prevent relative rotation or transmission of rotation or in order to further rigidify axial assembly, each connector body can be formed, at at least one of its ends, with a cavity having at least one male and/or female spline co-operable with an axial coupling member provided with a corresponding number of splines complementary in number and shape for the purpose of preventing relative rotation.

Preferred embodiments of the present invention will now be more particularly described by way of example with reference to the accompanying drawings, in which.

Figure 1:
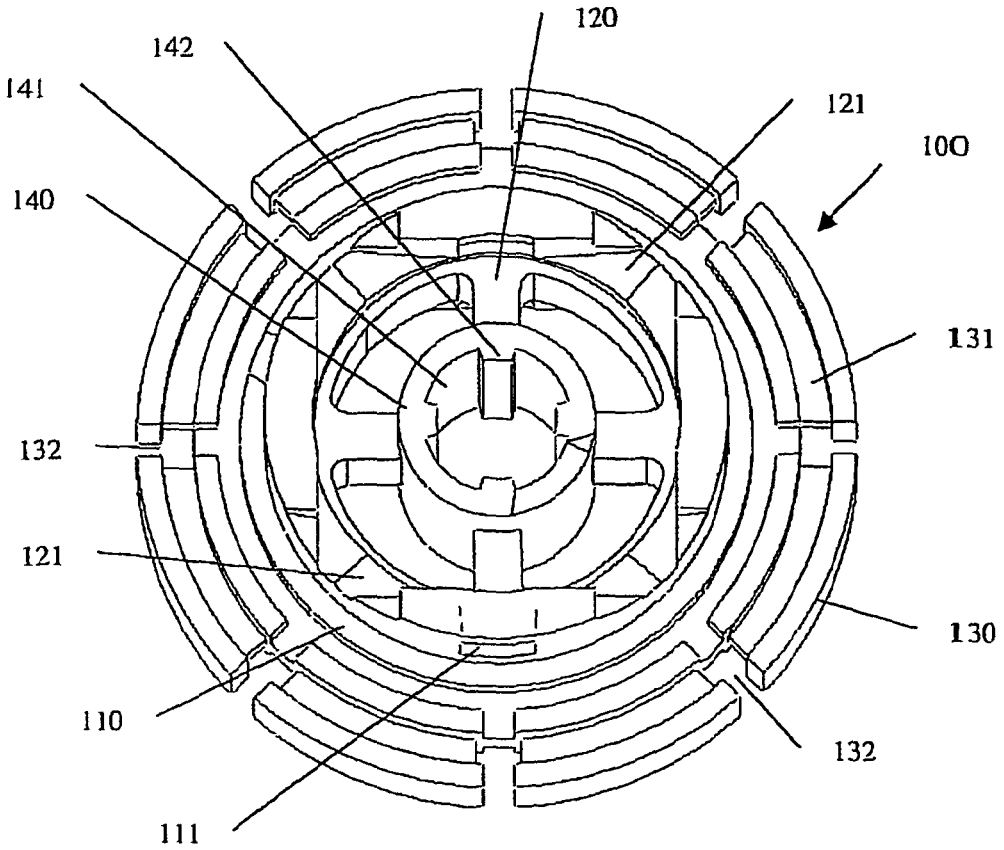
FIG. 1 is a perspective view of a connector constituting a first form of element in a construction set embodying the invention.

Referring now to the drawings there are shown different components of a construction set comprising a plurality of elements able to be interconnected in a variety of relationships to construct assemblies and subassemblies, including, for example, structures forming bodies of robots. The set is composed of a plurality of each of several different forms of element. In this context, the term "set" is to be understood as extending to a selectable agglomeration of elements for a defined purpose, thus, for example, the elements present in kind and number for constructing an assembly or a subassembly to a specific or preconceived design.

A core element of the set, namely a connector 100, is shown in FIGS. 1, 5, 6, 7, 8, 9, 10 and 14. The connector 100 comprises a substantially cylindrical body 110 having a cylindrical surface and a base 120, the cylindrical surface being shaped for co-operation, for the purpose of assembly, with the base of another connector of the set, and the base 120 itself being suitably shaped for the same purpose. Thus, the cylindrical surface has at least one radially outwardly extending cylindrical projection 130 which is engageable, for the purpose of assembly, in at least one groove 121 formed in the base 120 of another connector 100. The projection 130 and the groove 121 of each connector 100 accordingly have complementary shapes permitting assembly of two such connectors in a mutually orthogonal relationship by engagement of the projection 130 of one of the connectors in the at least one groove 121 of the other one of the connectors. As illustrated, the body 110 is hollow at least at its ends, thus at the base 120, and is formed at each end with four openings 111 each extending through the body on a respective axis perpendicular to the cylinder axis of the body so as to communicate with the interior of the base 120 and also with a respective one of the grooves 121. Each opening 111 has, in the illustrated embodiment, a rectangular profile.

The body 110, which is preferably entirely hollow, is provided internally and centrally with a cylindrical hub 140 coaxial with the axis of the body 110 and connected therewith at a spacing by way of four radially extending webs. The hub 140 defines a cylindrical cavity 141 with a plurality of equidistantly spaced, axially extending splines 142. Four such splines are shown in the illustrated embodiment, but a greater or lesser number of spines can be provided.

The cylindrical projection 130 forms a circular flange coaxial with the body 110 and has on each of its two mutually opposite axial end faces at least one circular channel 131. In the illustrated embodiment two such channels 131, which are concentric, are provided on each end face, each channel having a U-shaped cross-section radially of the body 110. The flange is additionally formed with radiating slots 132 extending entirely through the flange 130 between the end faces thereof. The slots 132 are disposed at uniform angular spacings around the axis of the body 110 and, in the illustrated embodiment, are eight in number. These slots are dimensioned to pass through the channel 131, which facilitates location of other elements of the set as will be subsequently described. Such a slot additionally serves as a visual guide to assist assembly processes.

Figure 2:
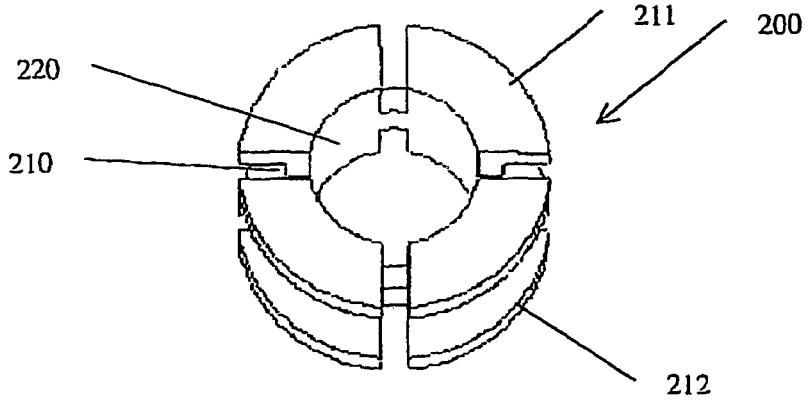
FIG. 2 is a perspective view of an axial adapter constituting a second form of element in the construction set.

FIG. 2 illustrates a further element of the set, in particular an axial adapter 200, which comprises a hollow cylindrical body 210 provided at each of the two ends thereof with a collar 211 or 212. The axial adapter 200 serves for axial assembly of two of the connectors 100. For this purpose, the adapter 200 has a cylindrical axial passage 220 with a diameter substantially equal to the diameter of the hub 140 so as to allow reception of the hub 140 in the passage 220, in which case the collar 211 or 212 rests in part on the webs connecting the hub with the body 110. The diameter of each of the collars 211 and 212 substantially corresponds with the diameter of the interior of the hollow base 120.

Figure 5:
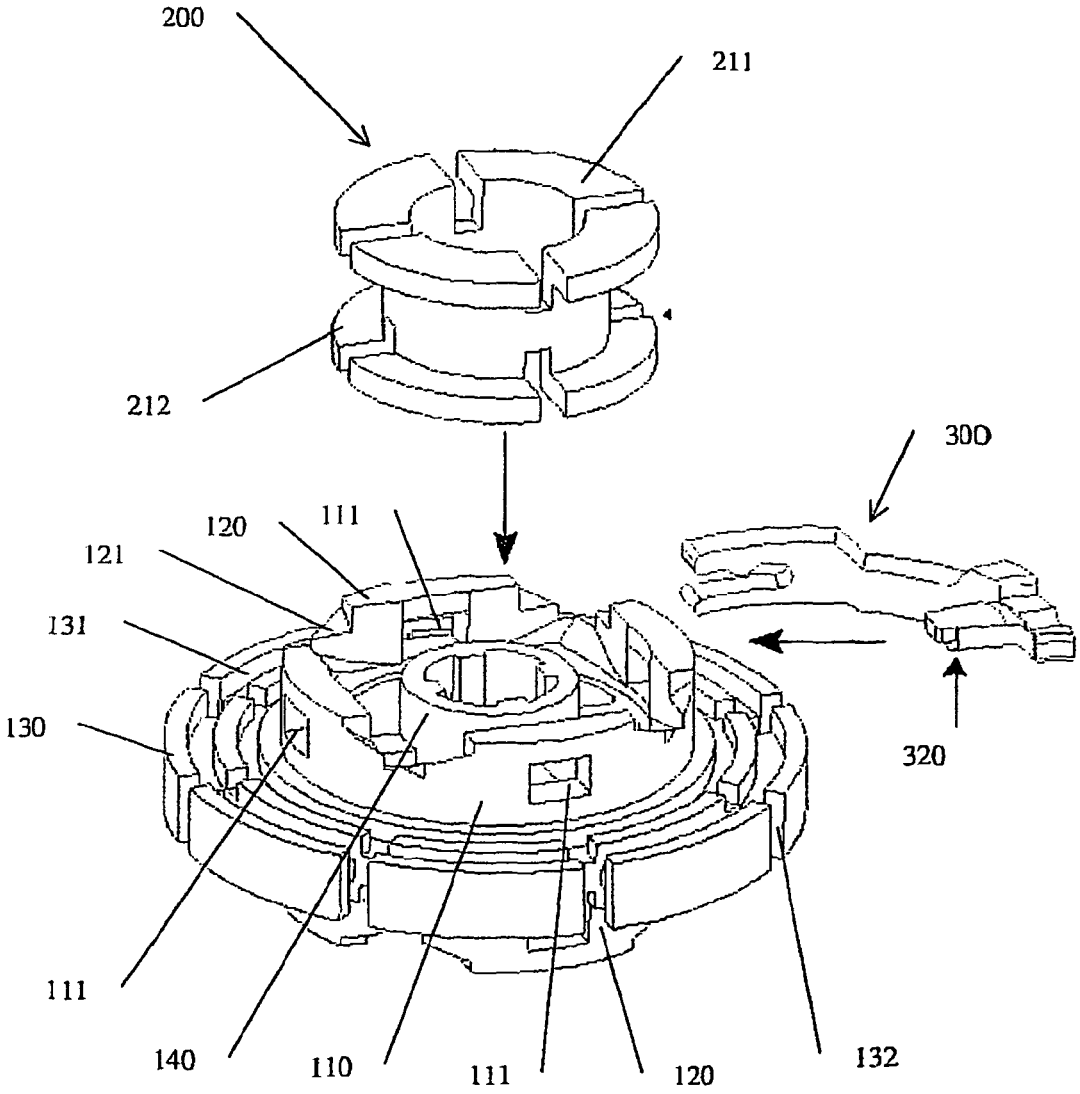
FIG. 5 is an exploded perspective view of an assembly composed of the connector, axial adapter and locking member.
Figure 14:
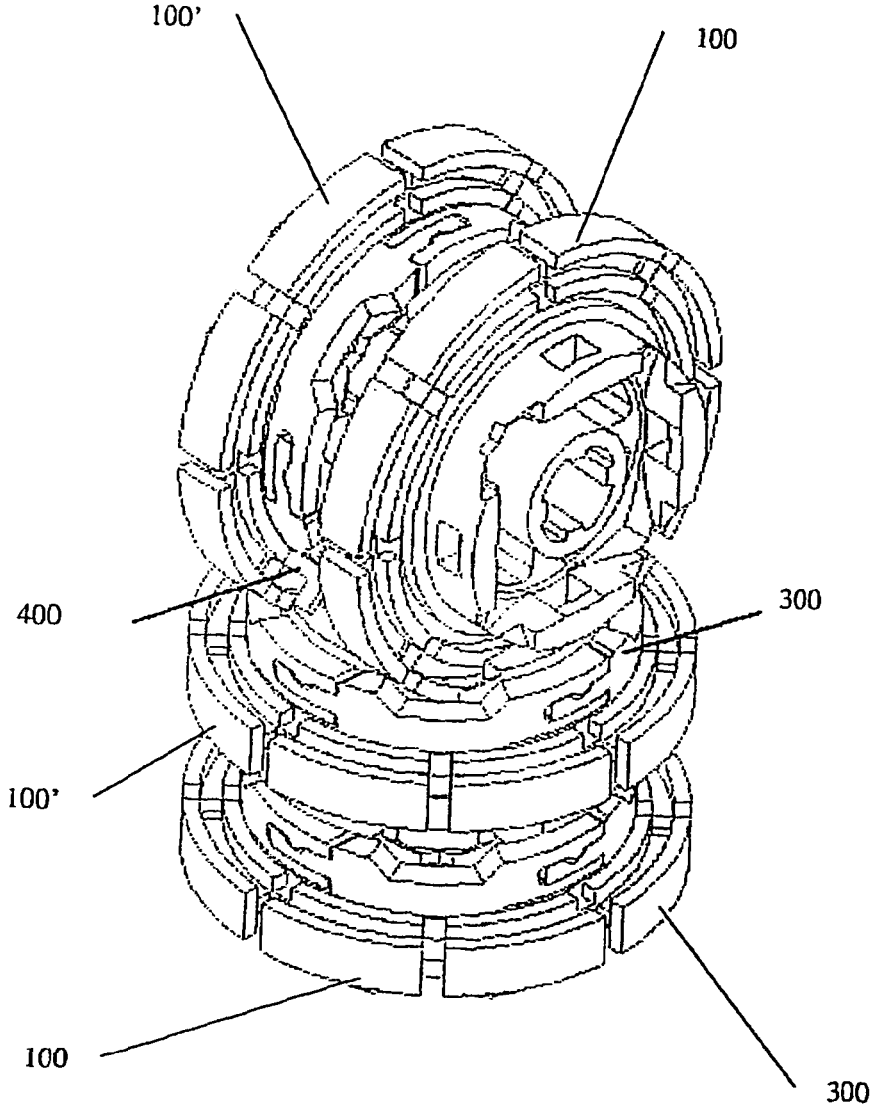
FIG. 14 is a view of an axial/orthogonal assembly composed of two pairs of coaxially arranged connectors, the pairs being in orthogonal relationship, three sets of the locking members, the axial adapter (not visible) and the orthogonal adapter.

This correspondence of respective diameters and consequent interaction of the axial adapters 200 and connectors 100 enable connecting arrangements such as illustrated in FIGS. 5 and 14 to be achieved, where connectors 100 and 100' can be assembled in an axial relationship by means of an axial adapter 200 between each two connectors.

It is also possible for a further element, which is not illustrated, of the set to consist of a single integral component having the form and dimensions of two connectors 100 (or 100 and 100') axially assembled by an axial adapter 200.

Figure 4:
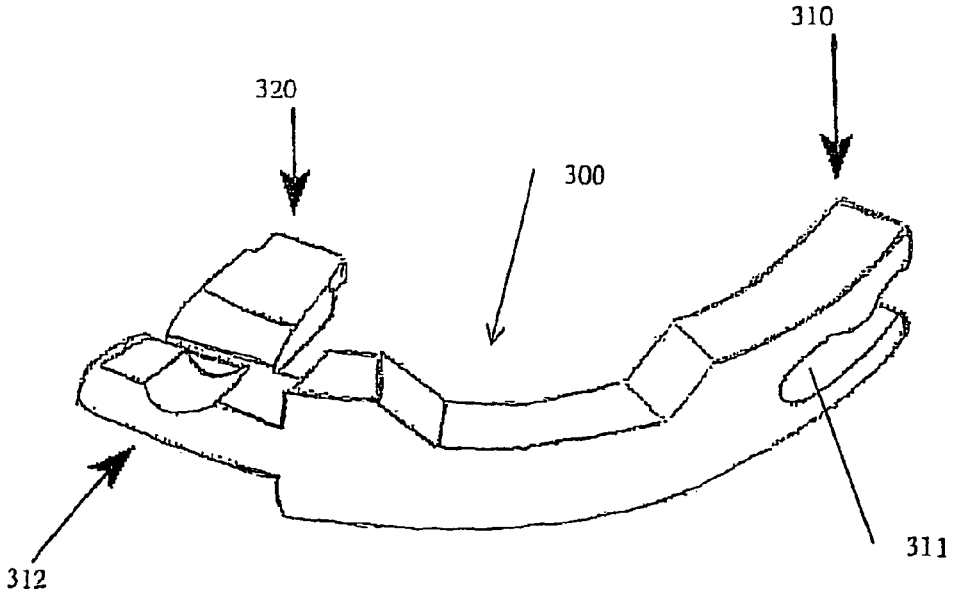
FIG. 4 is a perspective view of a locking member constituting a fourth form of element in the construction set.

The correspondence of dimensions, including diameters, may be such as to allow frictional assembly of the two connectors and axial adapter, thus an assembly in which the components remain in assembled state by virtue of frictional couples. However, in the interest of ensuring maintenance of the assembled state of the components under separating loads liable to overcome any such frictional couples, positive mechanical coupling of the components can be provided by a further element of the construction set, in particular a locking member 300 as shown in FIG. 4. The locking member 300 comprises a part-annular clasp 310 having, at its concave side, a radius of curvature substantially equal to that of the cylindrical surface of the body 110. The clasp 310 has at one of its two opposite ends and at the concave side a radially projecting locking nose 320 intended for engagement in any one of the openings 111 of the body 110 of a connector 100. The locking nose 320 is of such a length that it can extend through an opening 111 it which it is engaged so that its tip enters the interior of the base 120 and also the respective one of the grooves 121 with which that opening 111 communicates. The protruding tip of the locking nose 320 is able to serve as a locking abutment preventing withdrawal of a further element of the set engaged in the interior or specifically in the groove.

Thus, as illustrated in FIG. 5, when the axial adapter 200 is axially received in the interior of the body 110 of a connector 100 and located on the central hub 140, one of the collars—in this instance the lower collar 212—is so positioned that the openings 111 are disposed between the collar 212 and the adjacent end face of the base 120 of the body 110. Consequently, when a locking member 300 is positioned against the exterior surface of the body 110 of the connector 100 and the locking nose 320 thereof is inserted through one of the openings 111 the locking nose 320 provides an axial abutment relative to the collar 212 to prevent axial removal of the adapter 200 from the connector 100.

Figure 6:
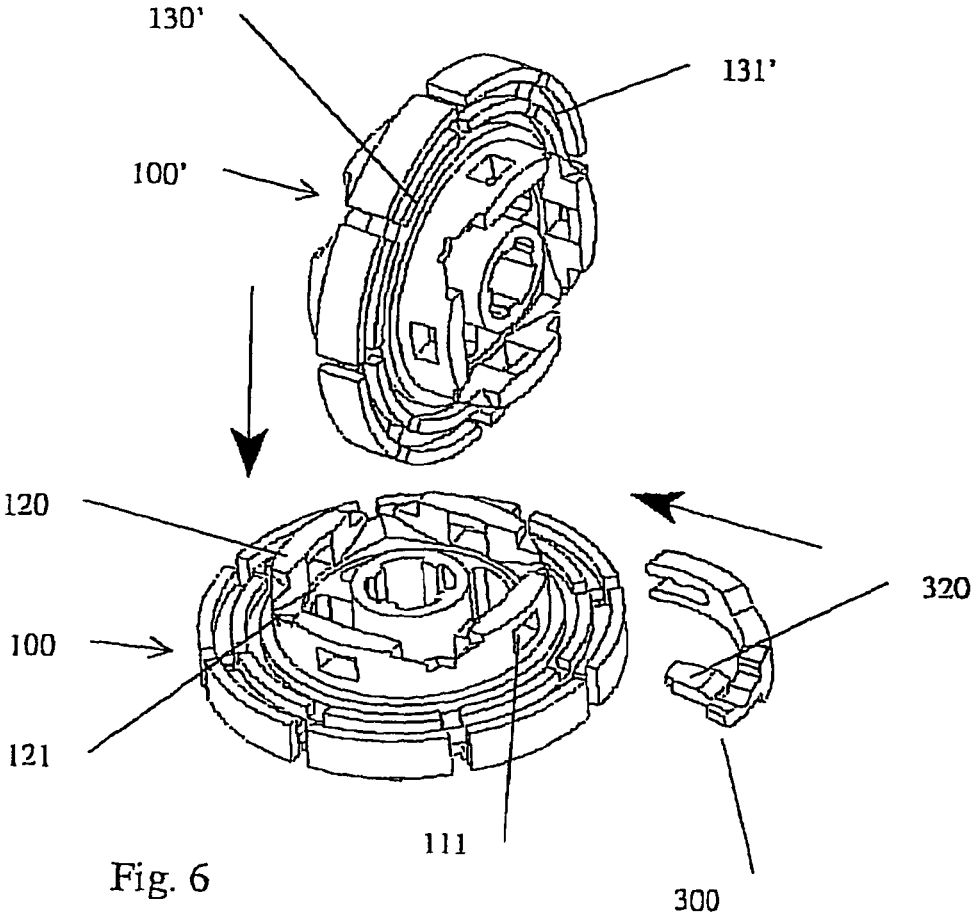
FIG. 6 is an exploded perspective view of an assembly composed of the locking member and two orthogonally arranged ones of the connectors.
Figure 7:
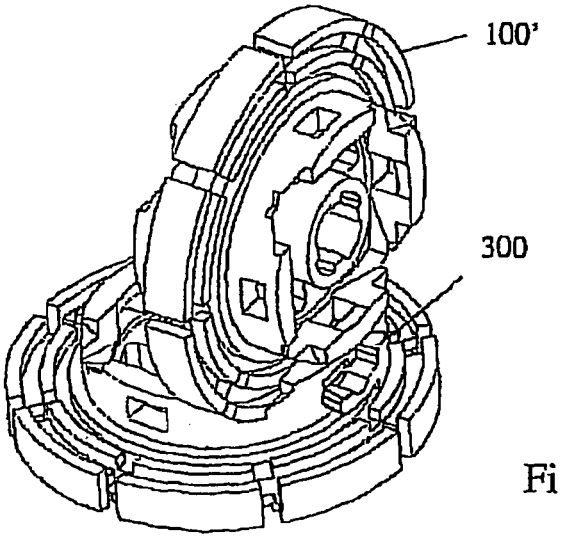
FIG. 7 is a perspective view of the assembly with the composition shown in FIG. 6.

The locking member 300 can also be employed for locking two orthogonally assembled connectors 100 and 100' as shown in FIGS. 6 and 7. In accordance with the afore-described basic construction of the connector 100 or 100', the body 110' of the latter is shaped for co-operation with the suitably shaped base 120 of the connector 100 for the purpose of assembly. In order to achieve this, the cylindrical surface of the connector 100 has the radially outwardly extending cylindrical projection 130' engageable in one of the conformably shaped grooves 121 in the base 120 of the element 100. As previously mentioned, this interengagement may provide a frictional couple between the two elements 100 and 100'. However, in order to also provide a mechanically positive coupling of the two elements use is made of the locking member 300. For this purpose, as previously mentioned each opening 111 is arranged to communicate not only with the interior in the hollow base 120 of the body 110, but also with a respective one of the four grooves 121 formed in the base 120. Thus, when the clasp of the locking member 300 is applied to the body 110 of the connector 100 and the locking nose 320 of the member 300 inserted through the opening 111 communicating with the groove 121 in which the projection 130' of the connector 100' is engaged, the tip of the locking nose 320 enters a channel 131' on the respectively associated side of the projection 130'.

The locking nose 320 thus constitutes a mechanically positive abutment which inhibits any possibility of movement of the connector 100' parallel to the axis of the connector 100 and consequently prevents the projection 130' from departing from the groove 121 in which it is engaged.

The locking member 300 and the elements of the set with which it can be associated incorporate further features optimising the function of locking together assembled elements, as described in the following.

The part-annular form of the clasp 310 carrying the locking nose 320 contributes to secure positioning of the nose and maintenance of the locking member in position. In this respect, the body 110 of each connector 100 or 100' has a series of the openings 111—which are equidistantly spaced—for insertion therethrough of the locking noses 320 of a corresponding series of locking members 300. As shown in FIG. 4, the mutually opposite ends 311 and 312 of the part-annular clasp 310 have, respectively, female coupling means and male coupling means of mutually complementary shapes, whereby the locking members 300 of the series can be coupled together by interengagement of the female and male coupling means 311, 312 of two adjacent ones of the locking members. Thus, when all of the openings 111 in the series are occupied by the locking noses 320 of the corresponding series of the locking members 300 the locking members can be joined together to form a continuous ring around the body 110.

Figure 8:
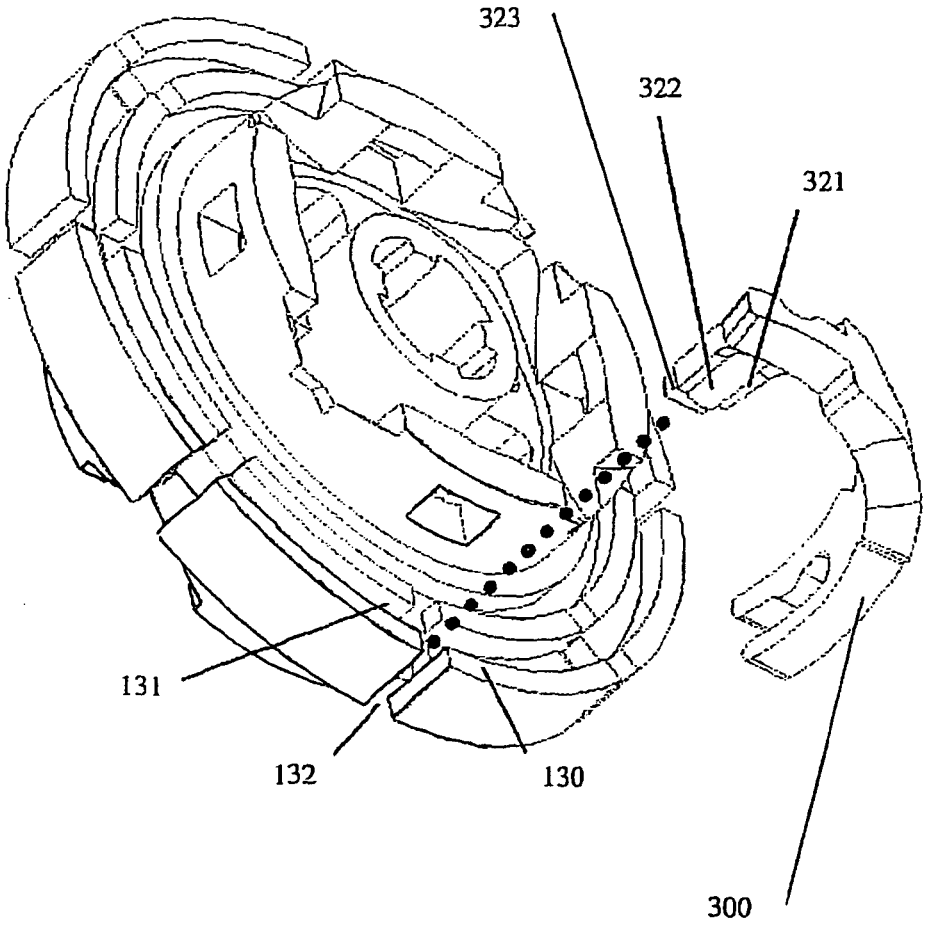
FIG. 8 is an exploded perspective view of an assembly of the connector and locking member in a mutually orthogonal relationship.
Figure 9:
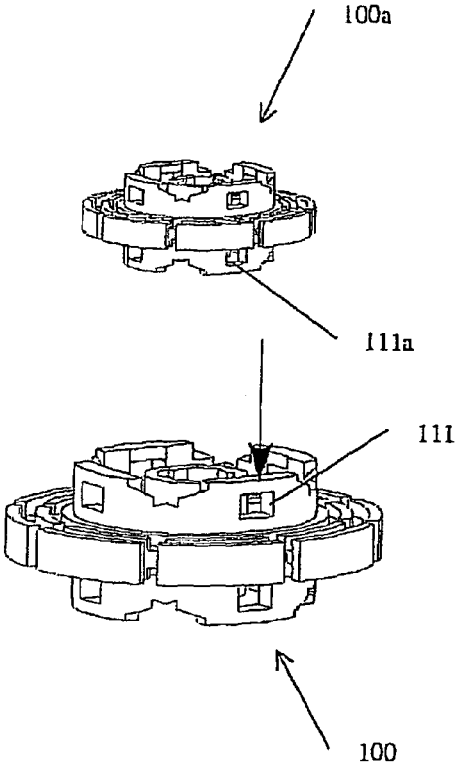
FIG. 9 is an exploded perspective view of an assembly composed of the connector and of a further such connector, but of smaller size.
Figure 10:
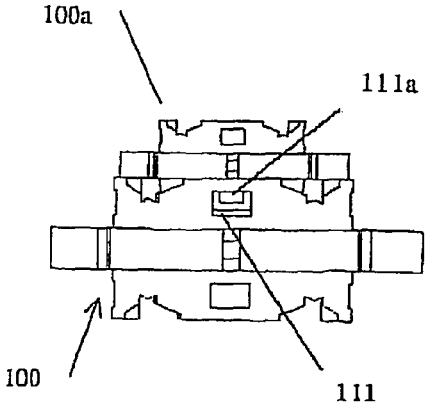
FIG. 10 is a side view of the assembly with the composition shown in FIG. 9.

The locking nose 320 of each locking member 300 is specifically shaped to perform a number of functions, in particular:

- As shown in FIG. 8, the nose has coplanar surfaces 321 to function as an abutment.
- The locking nose has a rib 322 selectively engageable in the slots 132 of the projection 130, or in slots in the collars 211, 212 of the axial adapter 200, for the purpose of blocking rotation.
- The nose 320 has at its free end protrusion 323 of reduced cross-section which allows the locking function of the locking member 300 to be performed in the case of an axial assembly—as shown in FIGS. 9 and 10—of a connector 100 and a smaller-size connector **100*a*, the latter having openings 111*a* of smaller dimensions than the openings 111**.

Figure 22:
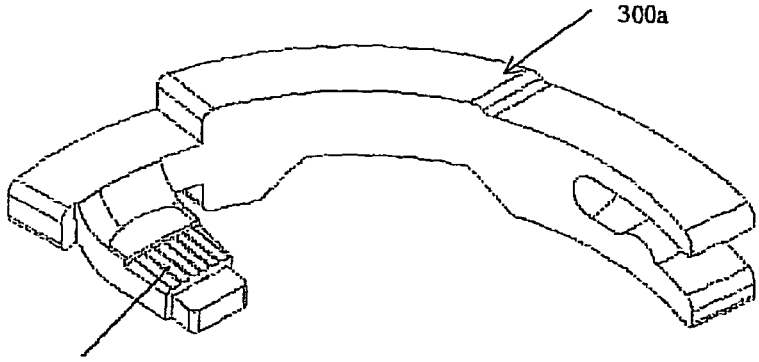
FIG. 22 is a perspective view of a further modified locking member.
Figure 23:
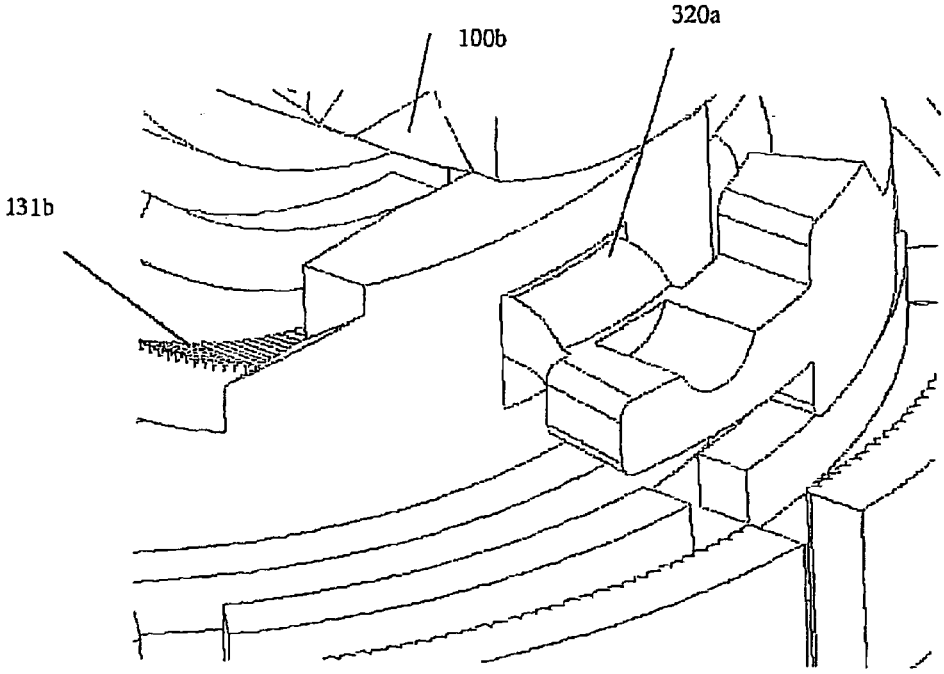
FIG. 23 is a detail perspective view, to enlarged scale, showing part of an assembly of one of the connectors and the further modified locking member.

A modified form of locking member **300*a* is illustrated in FIGS. 22 and 23. In this case, as an alternative to the rib 322 and in order to provide flexibility with respect to the possibilities of locked angular settings, the locking nose 320*a* of the locking member 300*a* has a profile surface formed with flutes or teeth co-operable with teeth of flutes of respectively complementary profile formed on a cylindrical wall surface of a channel 131*b* in a connector 100*b*, in particular the wall surface coming into contact with the profiled surface of the locking member 300***a* in the case of orthogonal assembly of connectors in the manner shown in FIGS. 6 and 7.

Figure 11:
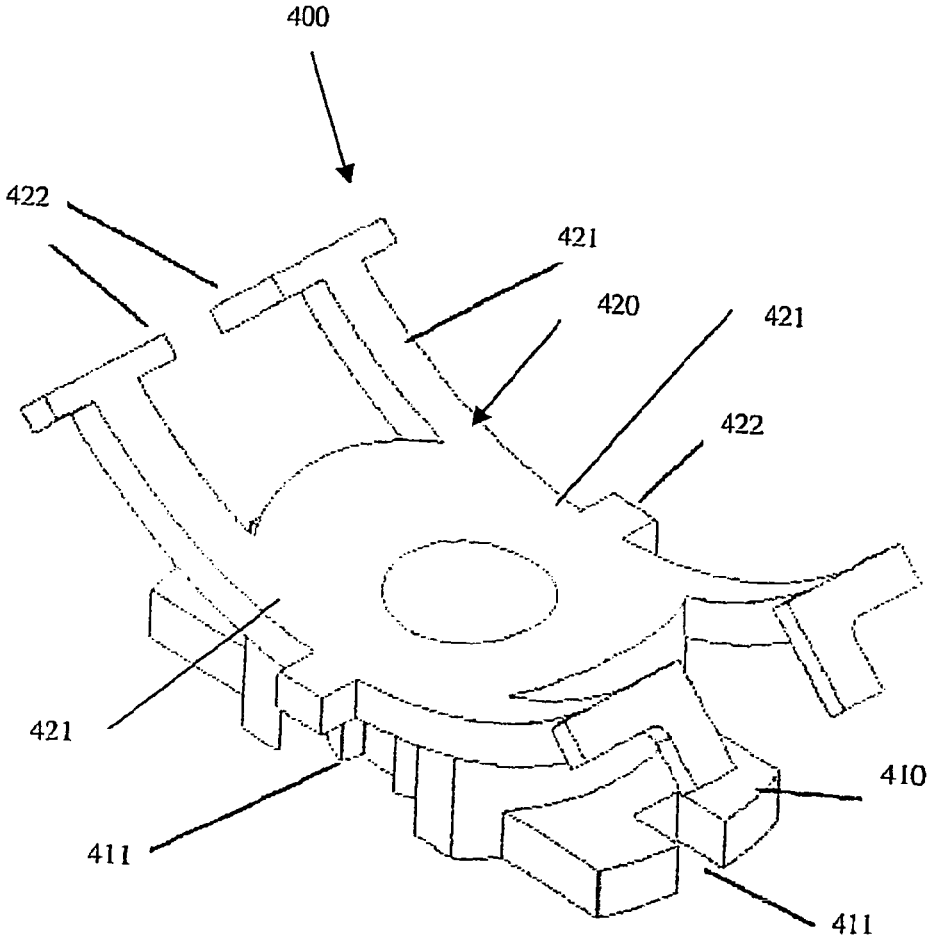
FIG. 11 is a perspective view of an orthogonal adapter constituting a fifth form of element in the construction set.
Figure 12:
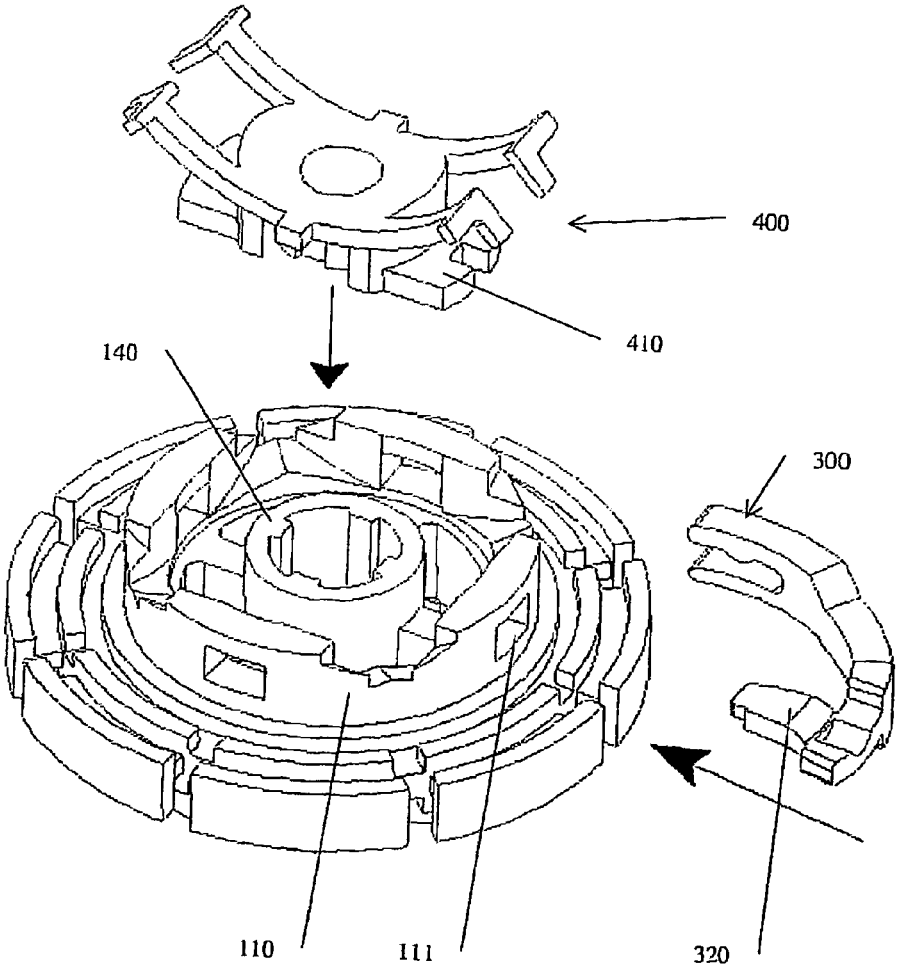
FIG. 12 is an exploded perspective view of an assembly composed of the connector, locking member and orthogonal adapter.
Figure 13:
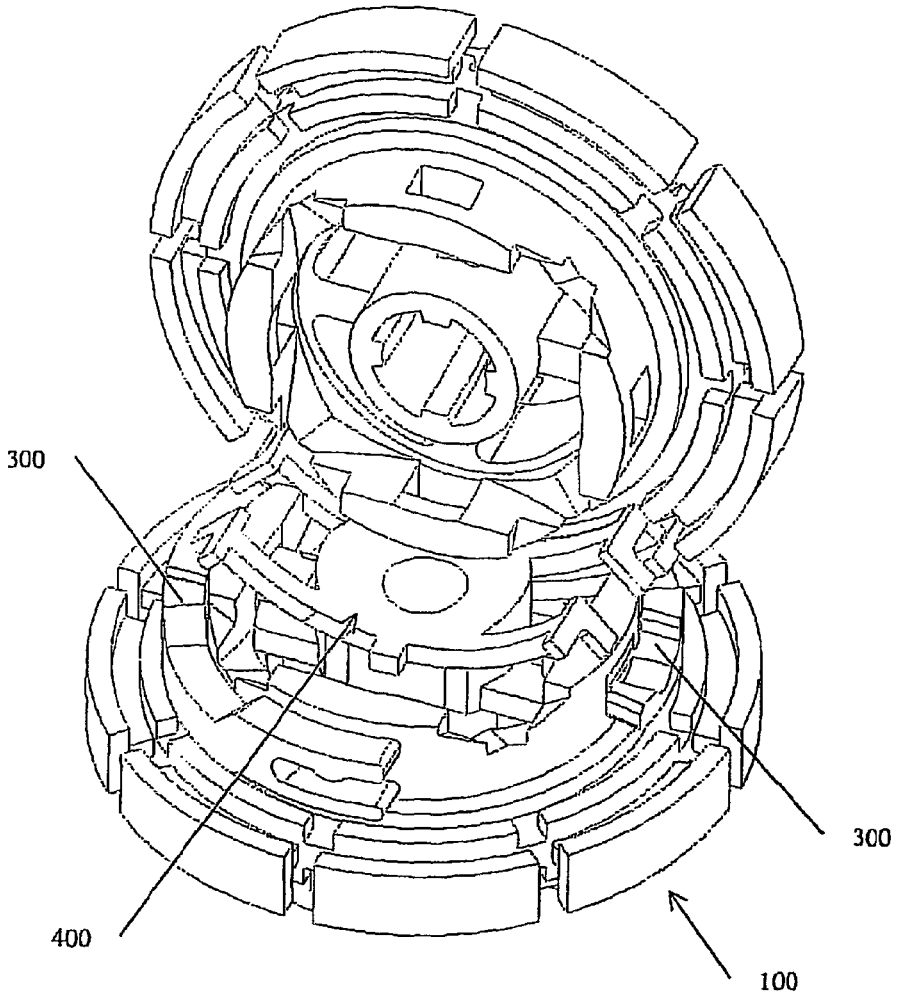
FIG. 13 is a view of an orthogonal assembly composed of the assembly of FIG. 12, a further, orthogonally arranged connector and further locking members.

In addition to or as an extension of the forms of assembly of connectors as described in the foregoing, FIG. 14 shows a more complex assembly formed by one pair of axially assembled connectors 100 and 100' assembled in orthogonal relationship with another pair of axially assembled connectors 100 and 100'. The orthogonal assembly can be advantageously achieved with use of a further element of the construction set, namely an orthogonal adapter 400 as shown in FIGS. 11 and 12, which comprises a peg 410 capable of axial insertion into the interior of the base 120 of the body 110 of a connector 100 and a cradle 420 with a part-cylindrical support surface with a notional cylinder axis orthogonal to the axis of the peg 410. The cradle 420 has two part-annular portions 421 of such a shape and size as to each be capable of co-operation by means of three equidistantly protrusions 422 with three successive ones of the slots 132 formed in the projection 130 of the connector 100, as illustrated in FIG. 13.

The peg 410 when inserted in the interior of the base 120 of a connector body 110 is located by the hub 140 and its kept in position by the locking noses 320 of two locking members 300 as evident from FIG. 12. As shown in FIG. 11, slots 411 are formed in flange portions of the peg 410 and co-operate with the locking noses 320 of the two locking members 300 similarly to the slots in the projection 130 of the connector 100 or the slots in the collars 211, 212 of the axial adapter 200.

The orthogonal adapter 400 rigidifies and thus optimises the orthogonal assembly of two coaxially assembled connectors with two other coaxially assembled connectors in the manner depicted in FIG. 14.

Figure 19:
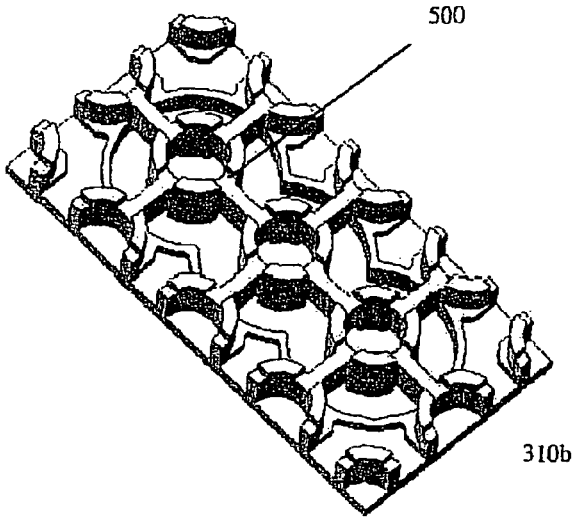
FIG. 19 is a perspective view of a modified axial adapter.
Figure 19:
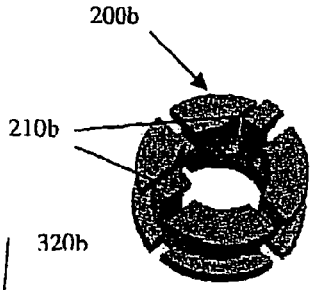
Figure 15:
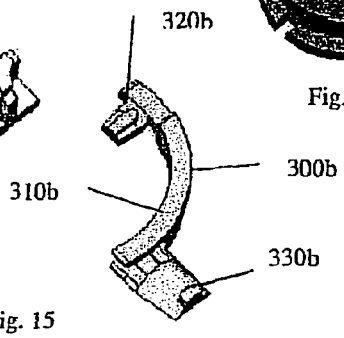
FIG. 15 is a perspective view of a connecting panel constituting a sixth form of element in the construction set, together with a modified locking member.
Figure 16:
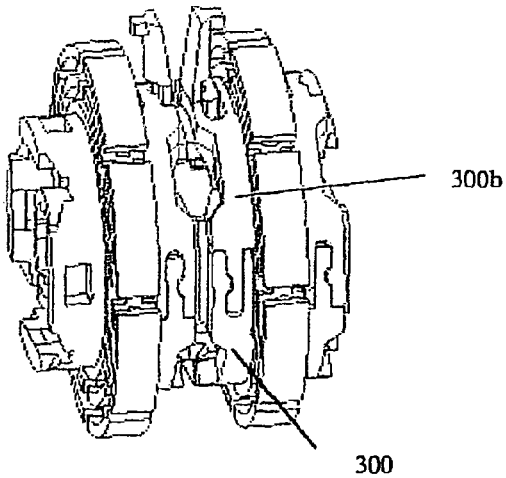
FIG. 16 is a perspective view of an axial assembly composed of two of the connectors and modified locking members of FIG. 15.
Figure 17:
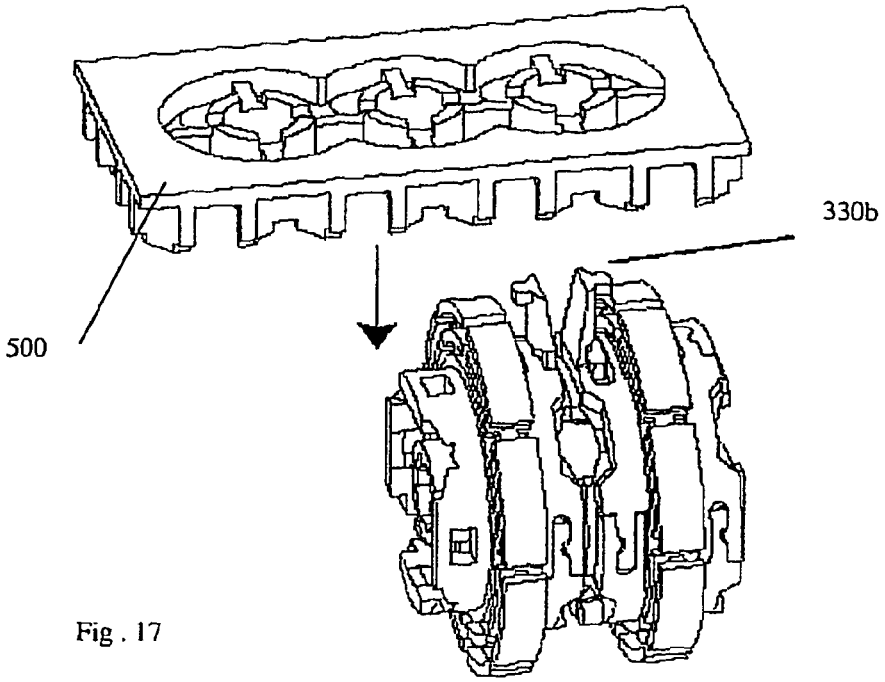
FIG. 17 is an exploded perspective view of an extended axial assembly composed of the assembly of FIG. 16 and the connecting panel of FIG. 15.
Figure 18:
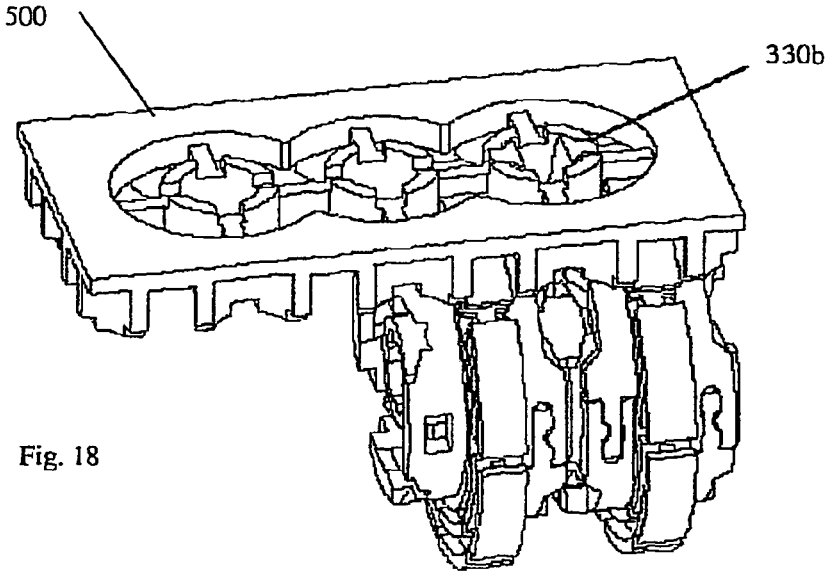
FIG. 18 is a perspective view of the extended axial assembly with the composition shown in FIG. 17.
Figure 20:
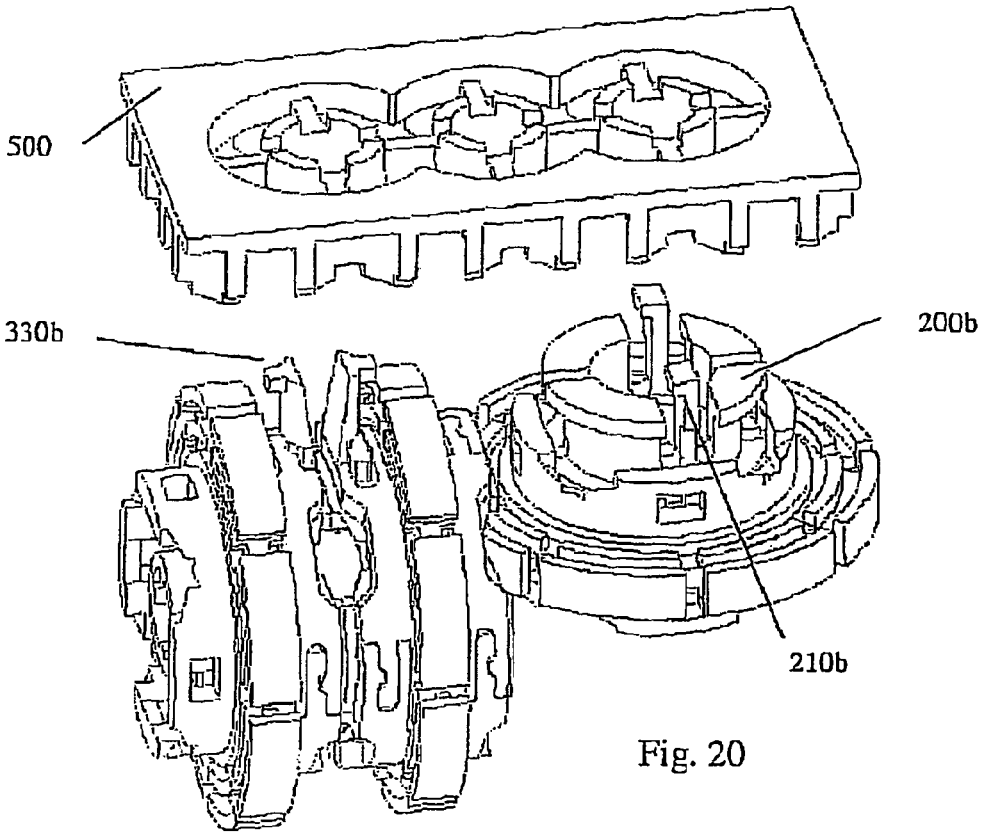
FIG. 20 is an exploded perspective view of an axial/orthogonal assembly composed of the extended axial assembly of FIGS. 17 and 18 and an orthogonally arranged assembly of a further one of the connectors and the modified axial adapter.
Figure 21:
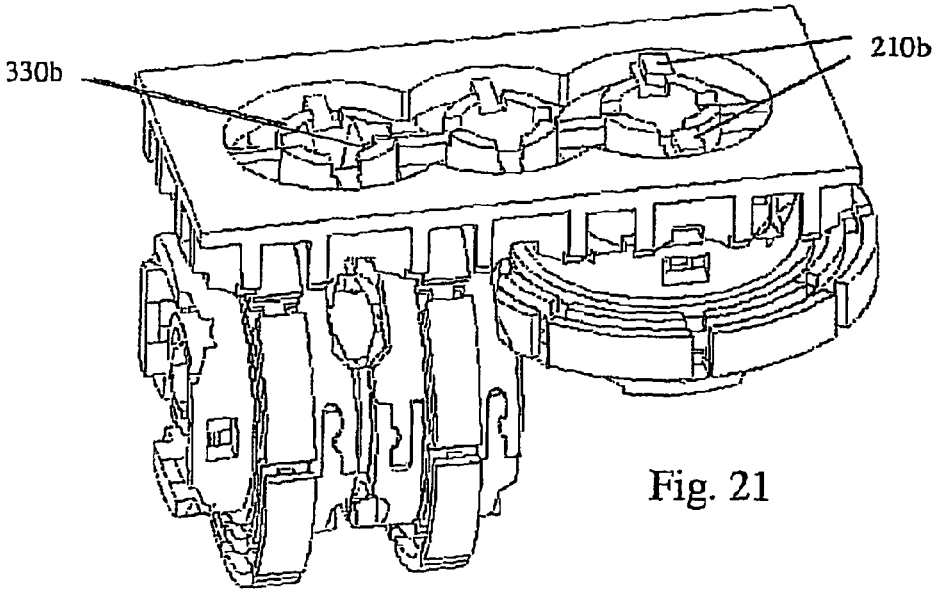
FIG. 21 is a perspective view of the axial/orthogonal assembly with the composition of FIG. 20.

In order to optimise an axial or orthogonal assembly of planar elements with connectors or with subassemblies achieved by axial assembly of two connectors, use can be made of a further modified locking member 300*b* as shown in FIG. 15. The modified locking member 300*b* again comprises a part-annular clasp 300*b* provided at one end on the concave side with a radially projecting locking nose 320*b* and provided at the other end on the convex side with a further radially projecting locking nose 330*b*, which in association can provide a profile for clipping with panel elements 500 of the construction set such as illustrated in FIGS. 16, 17 and 18. In order to couple with the panel elements 500, use is made of a modified axial adapter 200*b* which is shown in FIG. 19 and which, in departure from the previously described axial adapter 200, has two projecting clips 210*b* parallel to the axis of the adapter and allowing fixing of the panel element 500 as shown in FIGS. 20 and 21.

Figure 3:
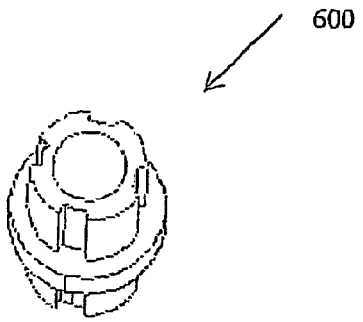
FIG. 3 is a perspective view of an axial coupling member constituting a third form of element in the construction set.

Yet another form of element of the construction set is shown in FIG. 3, namely an axial coupling member 600 provided with grooves for receiving the splines 142 provided in the cavity 141 of the hub 140 of the connector 100, the axial coupling member defining four relative angular settings of two axially assembled connectors. Such an assembly is shown in FIGS. 24 and 25.

Figure 24:
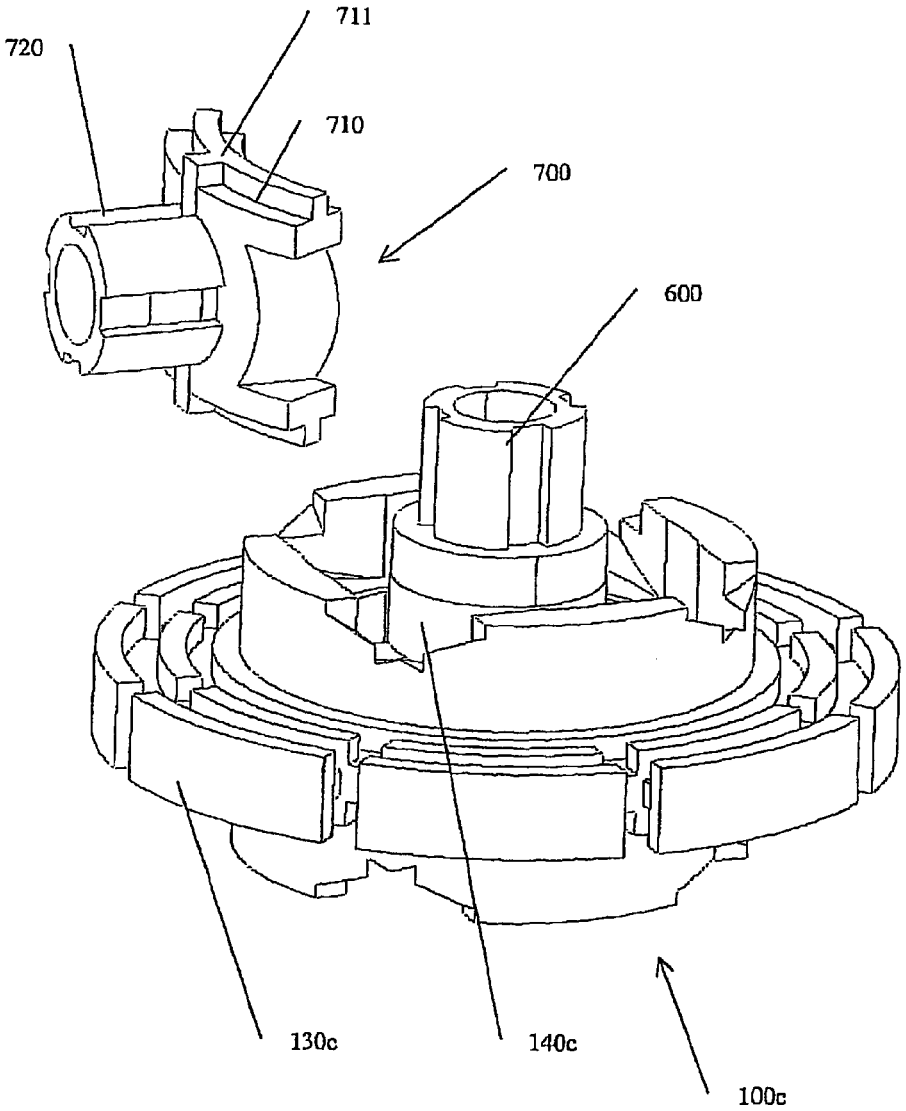
FIG. 24 is an exploded perspective view of an assembly composed of the connector, the axial coupling member and an orthogonal coupling member constituting a seventh form element in the construction set.
Figure 25:
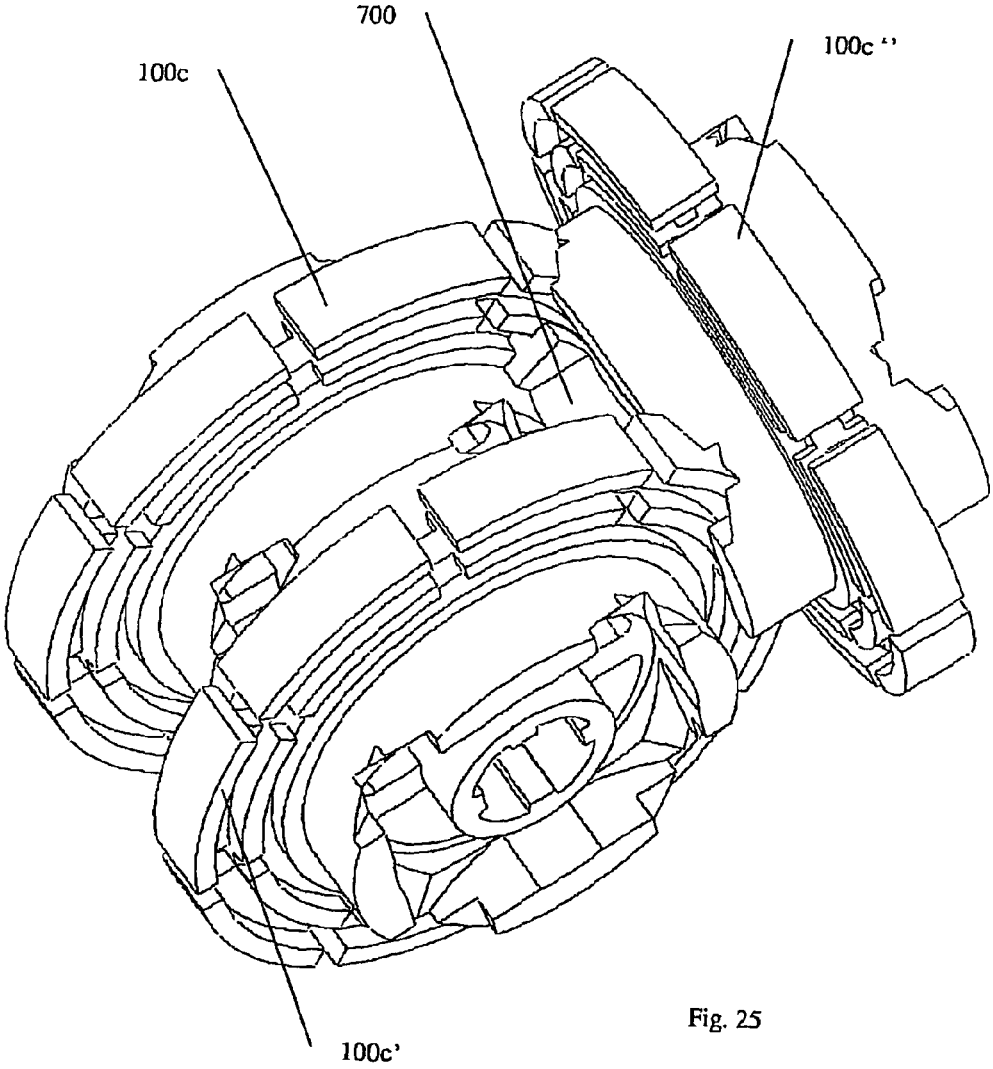
FIG. 25 is a perspective view of an axial/orthogonal assembly composed of the assembly of FIG. 24 and two further ones of the connectors.

FIGS. 24 and 25 also illustrate another element of the set, in particular an orthogonal coupling member 700, which does not require use of the locking members 300 and allows simpler connectors to be employed without the openings 111. The orthogonal coupling member 700 comprises an arcuate body 710 of which the mutually opposite arcuate edges 711 are shaped for co-operation with channels (corresponding with the channels 131) formed in the axial end faces of a projection 130*c* of a connector 100*c*. This connector 100*c* is shown in FIG. 24 with an axial coupling member 600 engaged in its hub 140*c*. The edges of the orthogonal coupling member 700 are also formed, in particular with ribs, for co-operation with slots (corresponding with the slots 132) formed in the projection 130*c*.

The orthogonal coupling member 700 further comprises a cylindrical post 720 projecting from the convex side of the body 710 perpendicularly to the notional cylinder axis of the body 710. This post 720 is formed with grooves for co-operation with the hub 140 of a connector 100, in particular, by interengagement of the respective grooves and splines in the manner described with respect to the axial coupling member 600.

The orthogonal coupling member 700 is shown in FIG. 25 with its arcuate edges engaged in channels in the connector 100*c* and a further connector 100*c*'. The connectors 100*c* and 100*c*' are joined by the axial coupling member 600 installed beforehand. A third connector 100*c*" can be orthogonally assembled with the axial assembly of the two connectors 100*c* and 100*c*' by engagement with the post 720 of the orthogonal coupling member 700, in particular by reception of the post in the hub of the connector 100*c*". As will be self-evident, the various connectors and members are so dimensioned that the grooves (corresponding with grooves 121) in the base of the connector 100*c*" co-operate with the radially extending cylindrical projections (corresponding with projections 130) of the two connectors 100*c* and 100*c*'.

It will be apparent that the afore-described elements forming the construction set can be modified without departing from the scope of the appended claims.

The invention claimed is:

1. A construction set comprising a plurality of elements mutually co-operable to produce at least one assembly, wherein the elements comprise:

a plurality of connectors each comprising a substantially cylindrical body having a cylindrical surface, a cylinder axis, and a hollow base defining an interior, the cylindrical surface being provided with a radially extending cylindrical projection and the base with at least one groove and the projection and the groove being shaped to permit assembly of two such connectors in mutually orthogonal relationship by engagement of the projection of one of those connectors in the at least one groove of the other one of those connectors, and a plurality of locking members of part-annular form curved substantially in conformity with the cylindrical surface of the body of each connector, the body of each connector being provided with at least one opening extending perpendicularly to the cylinder axis of that body to communicate with the interior of the base and each locking member being provided at a concave side thereof with a projecting locking nose insertable through the at least one opening of each connector to protrude into the interior of the base for axial retention of another element of the set assembled in a selectable one of an axial relationship and an orthogonal relationship with the respective connector.

2. The set according to claim 1, wherein the body of each connector is provided with a series of such openings each for insertion therethrough of the locking nose of a respective one of a corresponding series of the locking members, each locking member being provided at one end thereof with first coupling means and at an opposite end thereof with second coupling means and the first coupling means of each locking member in such a series being co-operable with the second coupling means of a respective other one of the locking members in the series to intercouple the locking members to form a ring around the body of the respective connector.

3. The set according to claim 1, wherein the elements of the set further comprise a plurality of axial adapters for assembly of connectors in axial relationships, each axial adapter having a collar engageable in the interior of the base of the body of such a connector and the locking nose of each locking member being insertable through the at least one opening in that body to provide in the interior of the base of the body an axial abutment preventing removal of the collar.

4. The set according to claim 1, wherein the locking nose has a tip and the at least one opening in the body of each connector communicates with the at least one groove in the base of that body and the projection of each connector forms a circular flange coaxial with the connector body and provided on at least one of its axial end faces with at least one circular channel for receiving the tip of the locking nose of a locking member when two such connectors are assembled in the mutually orthogonal relationship by engagement of the projection of a first one of the connectors in the at least one groove of the second one of the connectors and when the locking nose of that locking member is inserted through the at least one opening of the second one of the connectors to extend into the at least one groove of that connector.

5. The set according to claim 1, wherein the projection of each connector is provided with radially extending slots.

6. The set according to claim 5, wherein the elements of the set further comprise a plurality of orthogonal adapters for assembly of coaxially arranged connectors in an orthogonal relationship with a further connector, each orthogonal adapter comprising a peg insertable in the interior of the base of the body of the further connector and a cradle defining a part-cylindrical surface having a cylinder axis perpendicular to the axis of the peg.

7. The set according to claim 6, wherein the part-cylindrical surface of the cradle of each orthogonal adapter has a radius curvature which substantially corresponds with that of the body of each connector.

8. The set according to claim 6, wherein the locking nose of each locking member is insertable through the at least one opening in the body of each connector and into the interior of the base of the body so as to co-operate with the inserted peg of an orthogonal adapter in order to prevent separation of the adapter from the respective connector.

9. The set according to claim 4, wherein the elements of the set further comprise a plurality of orthogonal coupling members for assembly of a plurality of said connectors in orthogonal relationships, wherein each of the orthogonal coupling members comprises an arcuate body shaped at two mutually opposite arcuate edges thereof for engagement in said at least one circular channel of the circular flange of each said connector.

10. The set according to claim 9, wherein the projection of each connector is provided with radially extending slots and the arcuate body of each orthogonal coupling member is provided at the two opposite arcuate edges thereof with ribs for engagement in the slots.

11. The set according to claim 1, wherein the elements of the set further comprise a plurality of axial coupling members and the base of each connector includes a central hub with a cavity for receiving a respective one of the axial coupling members, the cavity and the axial coupling member having co-operable male and female locating means for locking a connector and an axial coupling member received in the cavity of the connector against relative rotation.

* * * * *